US009248993B2

(12) United States Patent
Studer

(10) Patent No.: US 9,248,993 B2
(45) Date of Patent: Feb. 2, 2016

(54) APPARATUS AND METHOD FOR MONITORING ELEVATOR SHAFT DOORS

(71) Applicant: INVENTIO AG, Hergiswil NW (CH)

(72) Inventor: Christian Studer, Lucerne (CH)

(73) Assignee: Inventio AG, Hergiswil (CH)

( * ) Notice: Subject to any disclaimer, the term of this patent is extended or adjusted under 35 U.S.C. 154(b) by 681 days.

(21) Appl. No.: 13/627,389

(22) Filed: Sep. 26, 2012

(65) Prior Publication Data

US 2013/0081906 A1 Apr. 4, 2013

(30) Foreign Application Priority Data

Sep. 29, 2011 (EP) ..... 11183303

(51) Int. Cl.
*B66B 13/14* (2006.01)
*B66B 5/00* (2006.01)
*B66B 13/22* (2006.01)

(52) U.S. Cl.
CPC ..... *B66B 5/005* (2013.01); *B66B 13/22* (2013.01)

(58) Field of Classification Search
CPC ..... B66B 5/005; B66B 13/22
USPC ..... 187/316, 317, 391, 393
See application file for complete search history.

(56) References Cited

U.S. PATENT DOCUMENTS

| | | | | | |
|---|---|---|---|---|---|
| 4,367,810 | A * | 1/1983 | Doane et al. | ..... | 187/280 |
| 4,750,591 | A * | 6/1988 | Coste et al. | ..... | 187/391 |
| 5,139,113 | A * | 8/1992 | Mizuno et al. | ..... | 187/393 |
| 5,760,350 | A * | 6/1998 | Pepin et al. | ..... | 187/316 |
| 5,817,993 | A * | 10/1998 | Kamani et al. | ..... | 187/316 |
| 6,484,125 | B1 * | 11/2002 | Huang et al. | ..... | 702/183 |
| 6,516,923 | B2 * | 2/2003 | Lence Barreiro et al. | .... | 187/391 |
| 6,543,583 | B1 * | 4/2003 | Lence Barreiro et al. | .... | 187/391 |
| 2012/0186914 | A1 * | 7/2012 | Birrer | ..... | 187/247 |
| 2012/0325588 | A1 * | 12/2012 | Loeb et al. | ..... | 187/247 |

FOREIGN PATENT DOCUMENTS

| | | | |
|---|---|---|---|
| EP | 1550845 | A1 | 7/2005 |
| WO | 99/47447 | A1 | 9/1999 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator installation has at least one shaft door and a monitoring device for monitoring movements for opening the shaft door, the monitoring device has a first, energy-autonomous counting device for counting the movements, which independently of an intact power supply increments a first count value in the case of one of these movements, and a second counting device for counting the movements, which when the power supply is intact increments a second count value in the case of one of these movements, and a comparison circuit which calls up and compares the first and second count values and can generate a signal based on the comparison of the count values.

18 Claims, 3 Drawing Sheets

| | |
|---|---|
| 2 | ELEVATOR INSTALLATION |
| 4a, 4b, 4c | SHAFT DOORS |
| 6 | CAGE |
| 8 | SHAFT |
| 10 | HEAD REGION |
| 12 | FLOOR REGION |

APPARATUS AND METHOD FOR MONITORING ELEVATOR SHAFT DOORS

CROSS-REFERENCE TO RELATED APPLICATION

This application claims priority to European Patent Application No. 11183303.4, filed Sep. 29, 2011, which is incorporated herein by reference.

FIELD

The disclosure relates to monitoring shaft doors of an elevator installation.

BACKGROUND

Monitoring of shaft doors is used in order to help ensure the safety of persons present in the elevator installation.

An elevator installation usually comprises an elevator shaft with a plurality of shaft doors and an elevator cage movable in the elevator shaft. Each shaft door is secured by a locking device. A shaft door contact is arranged at the locking device for the purpose of detection of unlocking. The shaft door contacts of several shaft doors are connected in series in a closed current circuit and are a component of a safety circuit. The closed current circuit is acted on by a basic voltage. In the case of unlocking of one of the shaft doors not attributable to a usual user-related utilization of the elevator cage this safety circuit is interrupted by the associated shaft door contact. After such an unlocking the assumption can be that a person is present in the elevator shaft outside the elevator cage. This can be caused by, for example, manual unlocking of the shaft door, but also by faulty functioning of the locking device.

Independently of re-locking subsequently taking place, an operating mode of the elevator installation is adapted. Travel or speed limitations are incorporated into a travel pattern of the elevator cage. It can thus be ensured that a person possibly present on the elevator cage or on the floor of the elevator shaft has sufficient room. The elevator installation can, instead, also be stopped as a precaution. In both cases a service specialist thereafter has to ensure on site that nobody is present in the elevator shaft outside the elevator cage. Only then can the specialist reset the elevator installation back to an operating mode corresponding with normal operation.

It can be problematic with such a procedure that the device for monitoring the shaft doors is 'blind' in the case of a longer-term power failure in which the basic voltage in the safety circuit cannot be maintained by a battery. Consequently, for reasons of safety it should be assumed after a longer-term power failure that a person is present in the shaft, although it is also possible that none of the shaft doors was unlocked during the power failure. It can thus be necessary in every instance for a service specialist to be on site if the power supply is guaranteed again and the elevator installation can be set back into normal operation.

SUMMARY

At least some embodiments comprise a device and a method for monitoring shaft doors which enable monitoring of the shaft doors in the case of power failures.

Some embodiments comprise an elevator installation with at least one shaft door and a monitoring device for monitoring movements for opening the shaft door, comprising a first, energy-autonomous counting device for counting the movements, which independently of an intact power supply increments a first count value in the case of one of these movements, and a second counting device for counting the movements, which when the power supply is intact increments a second count value in the case of one of these movements, and a comparison circuit which calls up and compares the first and second count values and can generate a signal based on the comparison of the count values.

Further embodiments comprise a method for monitoring movements for opening a shaft door, according to which the comparison circuit transmits demand signals to the first counting and memory circuit and to the second counting and memory circuit so that communication of the associated count values to the comparison circuit is triggered and the first count value is communicated to the comparison circuit, the second count value to the comparison circuit and the first count value is compared with the second value by means of an algorithm of the comparison circuit.

At least some embodiments are based on the recognition that an elevator installation drops into a voltage-free state in the case of a longer interruption in power. This occurs when during the power interruption even additional current stores, which are provided for bridging over power interruptions, have been discharged. During the voltage-free state it is also often not possible to monitor the shaft doors of the elevator installation.

Consequently, an access control into the elevator shaft is to an extent blind. After such a longer power interruption and before reinstatement of operation of the elevator installation it accordingly can be assumed that during the voltage-free state a shaft door was opened, a person entered the elevator shaft and the door was closed again. In order to help ensure the safety of this person, a service specialist on site can check the elevator shaft before reinstating operation. Only then can the elevator installation be released for normal operation again. With consideration of the fact that only in the fewest of cases with this check is a person actually present in the elevator shaft such a procedure can be needlessly cost-intensive. This includes not only out and back journeys of the service specialist, but also corresponding delays in reinstating operation of the elevator installation.

In order to help minimize expenditures resulting therefrom, it was accordingly sought to so change the monitoring for the elevator shaft that even in the case of imminent reinstatement of operation after a voltage-free state it can be unambiguously recognized whether the shaft door was opened. This is achieved by a monitoring device with two counting devices. One of these counting devices determines and stores a count value corresponding with a number of movements for openings of the shaft door when the power supply is intact. A further counting device determines and stores a count value corresponding with the number of the same movements of the shaft door not only when the power supply is intact, but also when it has failed. If a comparison of these two count values after the longer power interruption in the case of a power supply which is intact again yields agreement it can be concluded therefrom that the shaft door was not opened during the power interruption. If, however, these two count values differ, it can be assumed that the shaft door was opened. In this case the presence of the service specialist at the elevator installation can be necessary for reinstatement of operation. Moreover, it can be advantageous that in the case of constantly repeated comparison of the two count values a faulty functioning of the counting devices can be recognized on the basis of different count values even during normal operation. A further advantage can result from the fact that shaft doors or groups of shaft doors can be separately monitored. That can be helpful in the case of, for example, elevator installations with a high number of shaft doors in order to be able to find an individual shaft door having faulty functioning. In addition, a faulty functioning of individual counting devices can be recognized.

In some embodiments of the elevator installation the energy-autonomous counting device comprises a respective sensor arrangement which is associated with the shaft door and which comprises a permanent magnet and an induction unit, wherein both the permanent magnet and the induction unit are so arranged at the shaft door that through a change in the relative position of the permanent magnet with respect to the induction unit a voltage pulse is induced which increments the first current value in the case of movement for opening of the shaft door. Design of the sensor arrangement in this manner can mean that counting of the first count value takes place non-mechanically, thus possibly free of wear.

In some embodiments of the elevator installation the permanent magnet is arranged on a first part of the shaft door and the induction unit on the second part of the shaft door, wherein in the case of the movement the first part and the second part execute a movement relative to one another. It can be advantageous that the induction unit and the permanent magnet of the sensor arrangement can be arranged at a number of locations on the shaft door. In this manner, equipping of the shaft door with the sensor arrangement can be significantly simplified.

In addition, the energy-autonomous counting device can comprise a non-volatile first counting and memory circuit in which the first count value is stored and which can be activated, from a voltage-free state, and operated by the voltage pulse, and the voltage pulse in the case of movement for opening of the shaft door is a first count pulse which increments the first count value. In this manner it is possible to utilize energy from the movements for opening and closing the shaft door, yet to detect and count the movements for opening of the shaft door by means of selection circuit.

In addition, the induction unit can be formed from a ferromagnetic element, possibly Wiegand wire or a pulse wire, and an induction coil. In that way it is possible for the voltage pulse to be sufficiently energy-intensive in order to enable counting and storage of the first count value autonomously in terms of energy. Possible problems which arise through detection of energy pulses low in energy can thus be precluded.

In some embodiments of the elevator installation the second count device comprises a non-volatile second counting and memory circuit. In that way, the second count value can be stored over a time period of the failed voltage supply.

In some embodiments of the elevator installation the first count pulse increments the second count value when the power supply is intact. In that manner a single detecting device in the form of a sensor arrangement can generate a count pulse which can increment not only the first count value, but also the second count value. A difference of the two count values results from the fact that the second count value is incremented only when the power supply is intact and the first count value is incremented independently of the power supply. Thus, for example, outlay on installation of further detecting devices at the shaft door can be saved.

In some embodiments of the elevator installation the second counting device comprises a current circuit which is closed in the case of a closed setting of the shaft door and which can be interrupted at a contact point by the movement, and a voltage detector, which bridges over the current circuit and in the case of an interruption of the current circuit when the power supply is intact has the effect that the second count value is incremented. It can be advantageous that an existing current circuit at the shaft door can be utilized for incrementing the second count value. This current circuit can be acted on by a basic voltage when the power supply is intact. It can thus be ensured that the second count value can be incremented only when the power supply is intact. The second count value can comprise a non-volatile second counting and memory circuit, wherein the voltage detector in the case of exceeding of a voltage threshold value generates a second count pulse which increments the second count value stored in the second counting and memory circuit. A potential difference over the contact point can thus be used to increment the count value of the second counting device.

In some embodiments of the elevator installation the shaft door comprises a locking device with two parts movable relative to one another, and the movement for opening the shaft door is an unlocking process. It can be advantageous that the unlocking process of the shaft door can be used to detect the possible previous opening of the shaft door.

In some embodiments of the method the first count value is associated with a first time instant and the second count value with a second time instant, wherein the shaft door is always closed between the first and second time instants. In that manner the first and second count values can be compared with one another without these count values necessarily having had to be called up at the same point in time. Nevertheless, in the case of normal operation the same value for the first and second count values would be expected.

In some embodiments of the method the comparison circuit generates a non-correspondence signal in the case of detecting non-correspondence of the first count value with the second count value. It can be advantageous that the non-correspondence signal can be used to initiate further steps, for example calling a service specialist or a test routine.

A time period of "intact power supply" also includes a time period in which the power supply of the monitoring device is maintained by power storage means arranged in the elevator installation. The time period of the intact power supply is followed by a time period of the voltage-free state or the failed power supply. Power interruption, thereagainst, signifies that the energy supply of the elevator installation, which is provided, for example, by an electricity station, is not in operation. Thus, a time period of power interruption also embraces the time period in which the power supply of the monitoring device is maintained by power storage means.

BRIEF DESCRIPTION OF THE DRAWINGS

The disclosure is explained in more detail in the following by way of figures, in which.

DETAILED DESCRIPTION

Figure 1:
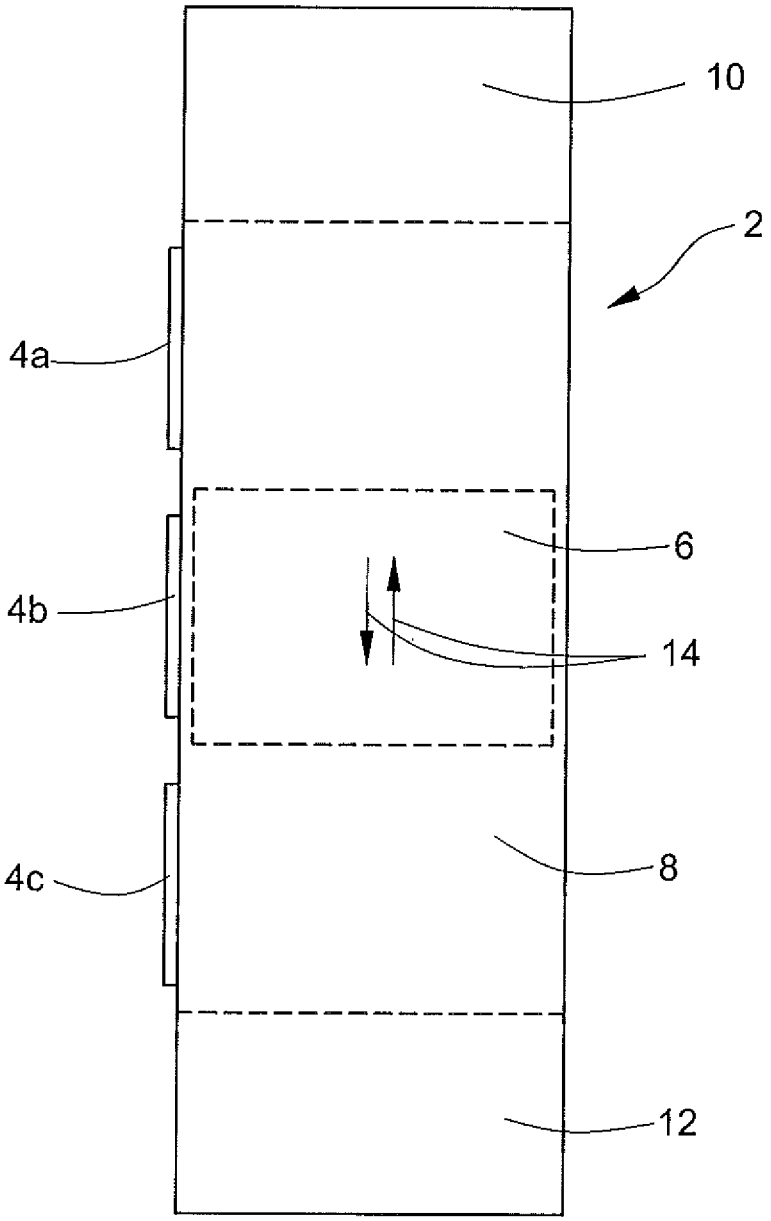
FIG. 1 shows an elevator installation with a plurality of shaft doors.

FIG. 1 shows an elevator installation 2. The elevator installation 2 comprises an elevator shaft 8 and a plurality of shaft doors 4*a*, 4*b*, 4*c* and an elevator control (not illustrated). In the elevator shaft 8, an elevator cage 6 can be moved along the elevator shaft 8 by means of a drive arrangement (not illustrated). In that case the elevator cage 6 executes a travel movement 14. The elevator shaft 8 can in addition comprise a floor region 12 and a head region 10, into which the elevator cage 6 cannot enter for safety reasons. Exemplifying parts of this drive arrangement are a drive engine, a support element and deflecting pulleys.

In an operating mode of the elevator installation 2 corresponding with normal operation the elevator cage 6 can be so moved in the elevator shaft 8 that persons can enter and leave the elevator cage 6 via the shaft doors 4*a*, 4*b*, 4*c*. A position of the elevator cage 6 which permits entry into or departure from the elevator cage 6 via the shaft door 4*b* is shown in FIG. 1. If a person enters the elevator shaft 8, for example on the elevator cage 6 through the shaft door 4*a* or below the elevator cage 6 through the shaft door 4*c*, it can be ensured that this person is not injured. In that case, "entering" the elevator shaft 8 means that the person does not go through the shaft door 4*a*, 4*c* into the elevator cage 6, but enters the elevator shaft 8 below the elevator cage 6. This entry is registered by the elevator control.

The elevator control can consequently have the effect that the operating mode of the elevator installation 2 is changed. Thus, the floor region 12 and the head region 10 can be present, which for their part represent safety regions into which the elevator cage 6 cannot penetrate. In order to be able to minimize dimensions of the elevator shaft 8, a travel pattern of the elevator cage 6 can be adapted in the case of the changed operating mode. For example, a maximum speed of the travel movement 14 can be reduced or the safety regions can be arranged in such a manner that the elevator cage 6 can no longer reach positions in the elevator shaft 8 which would have to be reached via the uppermost shaft door 4*a* or the lowermost shaft door 4*c* for entry into the elevator cage 6. Resetting of the elevator installation 2 into the operating mode, which corresponds with normal operation, can generally be performed only after a check of the elevator installation on site by a service specialist.

At least parts of different forms of embodiment of a monitoring device are illustrated in FIGS. 2 to 6.

Figure 2:
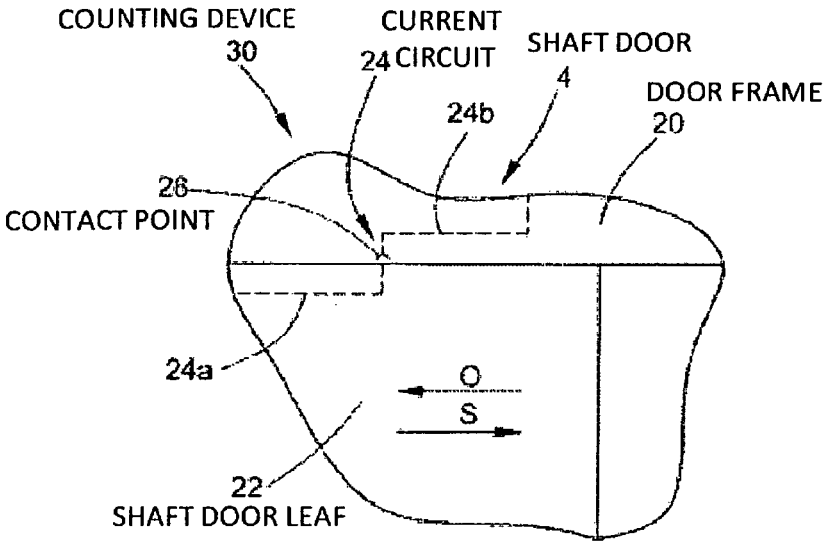
FIG. 2 shows a detail of a shaft door of the elevator installation.

FIG. 2 shows a detail of a shaft door 4 of an elevator installation. The shaft door 4 has a door frame 20 and a shaft door leaf 22, which can be opened by way of a shaft door opening movement O and thereafter closed again by way of a shaft door closing movement S. The shaft door opening movement O is a movement for opening the shaft door 4. The shaft door closing movement S is a movement for closing the shaft door 4. The door frame 20 and the shaft door leaf 22 are in that case parts which are movable relative to one another and which execute a relative movement with respect to one another at least in the case of the shaft door opening movement O. The shaft door 4 is shown in a closed state. Two parts 24*a*, 24*b* of a current circuit 24 are shown. One of these parts 24*a*, 24*b* can be arranged at the shaft door leaf 22 and a second, corresponding part 24*a*, 24*b* can be arranged at a door frame 20. The current circuit 24 additionally comprises a contact point 26 which in the closed state of the shaft door 4 conductively connects the parts 24*a*, 24*b* of the current circuit 24. The current circuit 24 is in the case of an intact current supply acted on by a basic voltage. As soon as a shaft door opening movement O arises the current circuit 24 is interrupted at the contact point 26. This can be detected by way of a drop in the basic voltage and monitored. Instead of monitoring an individual shaft door 4 of the elevator installation by such a current circuit 24 it is also possible for a group of shaft doors, thus at least two shaft doors 4*a*, 4*b*, 4*c*, illustrated in FIG. 1, to be incorporated in the current circuit 24. For this purpose the shaft doors 4*a*, 4*b*, 4*c* can be provided with such a contact point 26. The contact points 26 of the respective shaft doors 4*a*, 4*b*, 4*c* can then be connected in series within the current circuit 24. In the case of a shaft door opening movement O by one of the shaft doors 4*a*, 4*b*, 4*c* the current circuit 24 is interrupted and this shaft door opening movement O detected. The current circuit explained in FIG. 2 can be part of a counting device 30.

Figure 3:
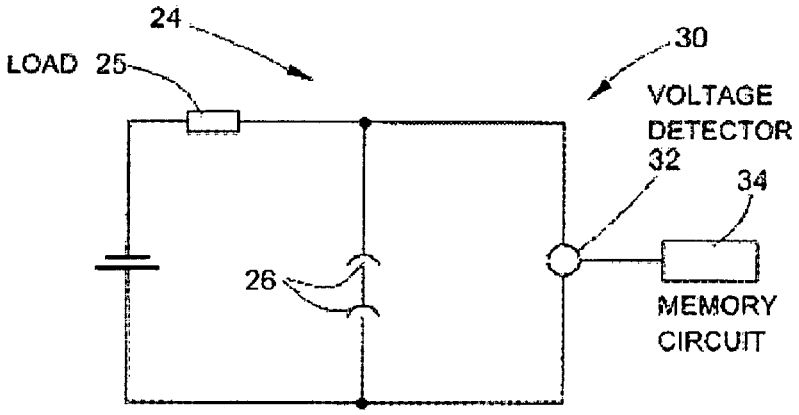
FIG. 3 shows a first counting device for counting movements for opening the shaft door.

FIG. 3 shows a counting device 30 for counting movements for the opening of a shaft door. The counting device 30 comprises a current circuit 24, a voltage detector 32 and a non-volatile counting and memory circuit 34. The current circuit comprises at least one contact point 26. The voltage detector 32 bridges over the at least one contact point 26. The illustrated current circuit 24 can be arranged the same as the current circuit shown in FIG. 2 and described. A load 25, for example a resistance, can be arranged in the current circuit 24. An interruption at the contact point 26 produces a potential difference detected by means of the voltage detector 32. A voltage threshold value of the voltage detector 32 has the effect that small voltage pulses acting on the voltage detector 32 do not cause generation of a count pulse. Such small voltage pulses can indeed arise when the current circuit 24 is closed, thus in the case of conductively connected contact points 26. Only on exceeding of the voltage threshold value, thus in the case of interruption of at least one of the contact points 26, is the count pulse generated by the voltage detector 32. The count pulse increments a count value which is filed in the counting and memory circuit 34. A memory unit of the counting and memory circuit 34 is non-volatile so that the incremented count value remains stored even during a voltage-free state.

Figure 4:
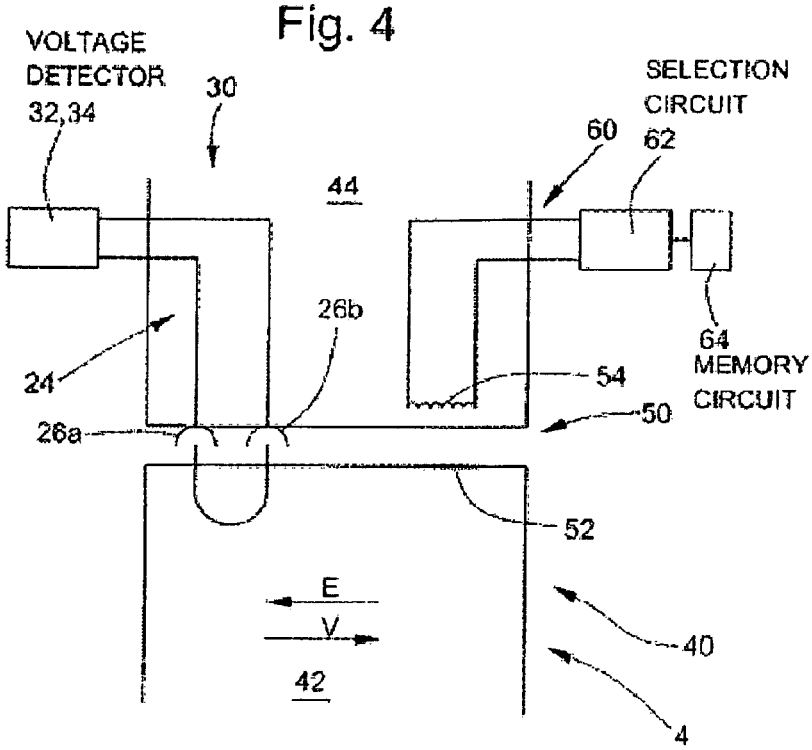
FIG. 4 shows an unlocking device of the elevator installation with a first counting device and a second counting device.

FIG. 4 shows a locking device 40, a first energy-autonomous counting device 60 and a second counting device 30, which are associated with a shaft door 4. The locking device 40 has two parts 42, 44 movable relative to one another, wherein, for example, a movable first part 42 can execute an unlocking movement E in the case of unlocking and a locking movement V in the case of locking. The locking device 40 is usually fastened to a shaft door leaf of the shaft door 4, but can also be fastened to other elements of the shaft door 4.

Components of the second counting device 30 are a current circuit 24 with a contact point 26*a*, 26*b*, a voltage detector 32 associated with the current circuit 24 and a non-volatile second counting and memory unit 34. The current circuit 24 is arranged at the parts 42, 44, which are movable relative to one another, in the way explained already in the description of FIG. 2. The second counting device 30 can be constructed in the way inferable from the description with respect to FIG. 3.

The unlocking movement E causes an unlocking of the shaft door leaf so that the shaft door 4 thereafter can usually be opened. Correspondingly the unlocking movement E is a movement for opening of the shaft door 4. The unlocking movement E has the effect that the current circuit 24 is interrupted. Correspondingly, unlocking processes of the shaft door 4 in the case of intact current supply can be counted and stored by means of a count value in a memory unit of the second counting and memory circuit 34.

Components of the first counting device 60 are a first non-volatile counting and memory circuit 64 and a sensor arrangement 50, which is arranged at the locking device 40. The sensor arrangement 50 comprises a permanent magnet 52 and an induction unit 54, for example a coil. The permanent magnet 52 is arranged on one of the two parts 42, 44 of the locking device 40. The induction unit 54 is arranged on the corresponding one of the two parts 42, 44 of the locking device 40. In the same way as contact points 26*a*, 26*b* of the second counting device 30 can be connected in series so as to monitor several shaft doors, sensor arrangements 50 of the first counting device 60 can also be connected in series. The two parts 52, 54 of the sensor arrangement 50 can be so arranged that in the case of the unlocking movement E and in the case of the locking movement V a voltage pulse is induced in the induction unit 54 by the permanent magnets 52. This voltage pulse can on occurrence of the unlocking movement E be declared as a first count pulse by means of a selection circuit 62. The first count pulse is utilized in order to increment a first count value which is filed in a memory unit of the first counting and memory circuit 64. In that case the energy of the voltage pulse is also utilized in order to activate and operate the counting and memory circuit 64 from a voltage-free state so as to enable incrementing of the first count value. This means that an energy intake, which derives from a relative movement of the permanent magnets 52 with respect to the induction unit 54, is not necessary for counting the unlocking movement E and incrementing the first count value within the first counting device 60. The first counting device 60 is autonomous in terms of energy.

The counting devices 30, 60 are so arranged at at least one shaft door that when the power supply is intact both counting devices 30, 60 have count values which are the same if the counting devices 30, 60 do not have faulty functioning. In addition to the unlocking movements E, which the second counting device 30 registers in the case of intact power supply and stores by means of the second count value, the first counting device 60 registers and stores by means of the first count value the unlocking movements E which occur during the voltage-free state.

It is additionally possible for the described current circuit 24 with the contact points 26*a*, 26*b* and the associated voltage detector 32 not to be components of the second counting device 30 of the described embodiments. Accordingly, the first count pulse, which is generated by means of the sensor arrangement 50, can in the case of intact power supply be additionally also used, apart from incrementing the first count value within the first counting and memory circuit 64, for incrementing the second count value of the second counting and memory circuit 34.

Such a sensor arrangement 50 of the energy-autonomous counting device 60 can also be so arranged, additionally to elements of the counting device 30 shown in FIG. 2 or—according to the foregoing embodiments—instead of these elements of the counting device 30, at the at least one shaft door 4*a*, 4*b*, 4*c* of FIG. 2 in order to detect the shaft door opening movements O.

The sensor arrangement 50 or at least one of the counting devices 30, 60 can be connected by a bus system with a comparison circuit of the monitoring device.

Figure 5:
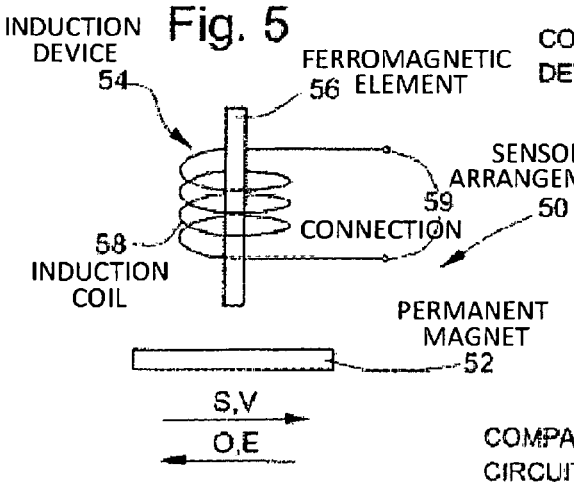
FIG. 5 shows an exemplifying sensor arrangement of the mentioned second counting device.

FIG. 5 shows an exemplifying sensor arrangement 50 of the afore-mentioned energy-autonomous first counting device. The sensor arrangement 50 comprises a permanent magnet 52, an induction unit 54 and a connection 59 to the remaining components (not illustrated) of the energy-autonomous first counting device. The induction unit 54 comprises a ferromagnetic element 56 and an induction coil 58. The permanent magnet 52 and the induction unit 54 are fastened to corresponding parts of a shaft door, which can execute relative movements with respect to one another. One of the relative movements is a movement for opening O, E of the shaft door. A second one of the relative movements can be a movement for closing S, V of the shaft door. The ferromagnetic element 56 can be formed from, for example, a Wiegand wire or a pulse wire. The ferromagnetic element 56 is in a position, in the case of approach, of assisting increasing collection or storage of energy in the magnetic field existing between it and the permanent magnets 52, wherein this energy is derived from the movement energy of the relative movements O, E, S, V. If the permanent magnet 52 reaches a defined position with respect to the ferromagnetic element 56 and thus the magnetic field strength prevailing in the ferromagnetic element 56 attains a defined magnitude, then the collected energy, even when the approach takes place extremely slowly, is abruptly liberated. Such an abruptly changing magnetic field generates in the induction coil 58 an energy-intensive voltage pulse sufficient for incrementing a first count value stored in the energy-autonomous first counting device. Any arrangement of the permanent magnet 52 and the induction unit 54, possibly comprising the ferromagnetic element 56 and the induction coil 58, which permits the mentioned sufficiently high level of liberation of energy is possible.

EP 1550845 shows, by way of example, how connection of another counting device can be executed.

Figure 6:
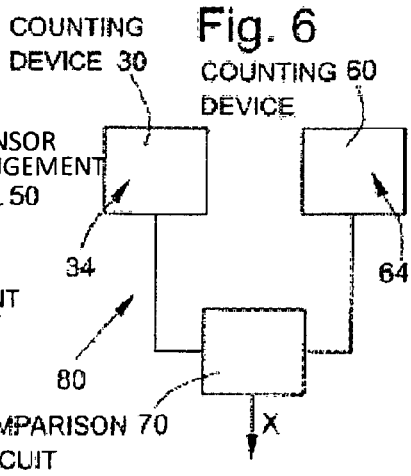
FIG. 6 shows a circuit diagram of a monitoring device.

FIG. 6 shows a block circuit diagram of a monitoring device 80. The monitoring device 80 comprises a first energy-autonomous counting device 60, a second counting device 30 and a comparison circuit 70. The first counting device 60 comprises a first counting and memory circuit 64 and the second counting device 30 comprises a second counting and memory circuit 34. Elements of the two counting devices 30, 60 are described in the embodiments with respect to FIGS. 2 to 5 and are not shown in FIG. 6. A first count value is stored within the first counting device 60 and a second count value is stored within the second counting device 30.

A method of monitoring shaft doors can include the following steps:

- The comparison circuit 70 transmits demand signals to the first counting and memory circuit 64 and to the second counting and memory circuit 34, so that transmission of the associated count values to the comparison circuit 70 is triggered.
- The first count value is communicated to the comparison circuit 70.
- The second count value is communicated to the comparison circuit 70.
- The comparison circuit 70 compares the first count value with the second count value by means of an algorithm.

A comparison of the two count values supplies useful statements with respect to the state of the elevator installation. Accordingly, a signal X which corresponds therewith—i.e. is based on the comparison of the count values—and which can be further used, can be generated. If it results from the comparison of the two count values that these do not correspond, a non-correspondence signal can be generated. Accordingly, a defect of the monitoring device 80 can be present or during a time period with failed power supply a movement for opening of the shaft door has been detected by the energy-autonomous first counting device 60. Since the monitoring device 80 is provided as a safety-relevant device in the elevator installation, an alarm signal can be triggered and the elevator installation shifted into an appropriate operating mode. For example, this alarm signal can provide an advance check of the elevator installation by a service specialist as a precondition for further operation of the elevator installation in normal operation. In the case of intact power supply, transmission of demand signals according to the mentioned method step can be carried on the basis of a freely selectable interrogation plane so that, with an intact power supply, faulty functioning of the first or second counting device 30, 60 can be detected.

The monitoring device 80 can additionally comprise elements of an elevator control of an elevator installation. Data relating to signals for opening of doors of the elevator installation are processed in these elements. Accordingly, it can be established, for example, to what extent a status of the first count value corresponds with a status of the second count value. A comparison of a first count value with a second value, wherein the two count values represent a number of movements for the opening of the shaft door at different points in time, is permitted only, for example, when between a first time instant, which can be associated with the first count value, and a second time instant, which can be associated with the second count value, no movement, which is detected by the monitoring device 80, for opening of the shaft door has taken place.

Further known electrical components and circuits (not illustrated) can be a component of the monitoring device illustrated in FIGS. 2 to 6 in order to enable signal processing in accordance with this step.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation, comprising:

a shaft door; and a monitoring device for monitoring the shaft door, the monitoring device comprising, a first counting device, the first counting device being energy-autonomous and being configured to increment a first counter in response to movements of the shaft door and independently of an elevator installation power supply, a second counting device, the second counting device being configured to increment a second counter in response to the movements of the shaft door when the elevator installation power supply is operating, and a comparison circuit coupled to the first and second counters, the comparison circuit configured to determine if the increments of the first counter agree or differ with the increments of the second counter; and whereas an agreement or a difference of the increments of the first and second counters is configured to indicate whether or not the shaft door was moved during an interruption of the elevator installation power supply.

2. The elevator installation of claim 1, the first counting device comprising a sensor arrangement, the sensor arrangement comprising a permanent magnet and an induction unit, the permanent magnet and the induction unit being arranged at the shaft door such that a change of relative position of the permanent magnet and the induction unit, as a result of the movements of the shaft door, increments the first counter.

3. The elevator installation of claim 2, the permanent magnet being arranged on a first part of the shaft door, the induction unit being arranged on a second part of the shaft door, the first and second parts of the shaft door moving relative to each other during the movements of the shaft door.

4. The elevator installation of claim 2, the first counting device further comprising a non-volatile counting and memory circuit that can, from a voltage-free state, be activated and operated by a voltage pulse.

5. The elevator installation of claim 4, the second counter being incremented by the voltage pulse when the elevator installation power supply is operating.

6. The elevator installation of claim 2, the induction unit comprising a ferromagnetic element and an induction coil.

7. The elevator installation of claim 6, the ferromagnetic element comprising a Wiegand wire or a pulse wire.

8. The elevator installation of claim 1, the second counting device comprising a non-volatile counting and memory circuit.

9. The elevator installation of claim 1, the second counting device comprising:

a current circuit, the current circuit being closed when the shaft door is closed; and a voltage detector, wherein the voltage detector can interrupt the current circuit and increment the second counter when the elevator installation power supply is operating.

10. The elevator installation of claim 9, the current circuit being acted on by a basic voltage when the elevator installation power supply is operating.

11. The elevator installation of claim 9, the voltage detector being configured to generate a count pulse when a voltage threshold value is exceeded, the count pulse incrementing the second counter.

12. The elevator installation of claim 9, the shaft door comprising a locking device, the locking device comprising first and second locking device parts, the first and second locking device parts being movable relative to each other, a contact point being arranged between the first and second locking device parts.

13. An elevator installation method, comprising:

opening a shaft door of an elevator installation;

in response to the opening the shaft door, incrementing at least one of a first counting device for monitoring the shaft door and a second counting device for monitoring the shaft door, the first counting device being configured to operate independently of a power supply, the second counting device being configured to operate dependent on the power supply;

comparing values stored in the first and second counting devices; and using the comparison of the values to determine if the increments of the first counter agree or differ with the increments of the second counter, and whereas an agreement or a difference of the increments of the first and second counters is configured to indicate whether or not the shaft door was moved during an interruption of the power supply.

14. The elevator installation method of claim 13, further comprising requesting that the values stored in the first and second counting devices be sent to a comparison circuit.

15. The elevator installation method of claim 14, the value stored in the first counting device being associated with a first point in time, the value stored in the second counting device being associated with a second point in time, the shaft door being closed between the first and second points in time.

16. The elevator installation method of claim 13, further comprising generating a non-correspondence signal if the values stored in the first and second counting devices are different.

17. The elevator installation method of claim 16, further comprising triggering an alarm signal as a result of determining that the values stored in the first and second counting devices are different.

18. An elevator shaft door monitoring device, comprising:

a first counting device, the first counting device being energy-autonomous and being configured to increment a first counter in response to movements of a shaft door and independently of a power supply;

a second counting device, the second counting device being configured to increment a second counter in response to the movements of the shaft door when the power supply is operating; and a comparison device coupled to the first and second counters, the comparison device configured to determine if the increments of the first counter agree or differ with the increments of the second counter, and whereas an agreement or a difference of the increments of the first and second counters is configured to indicate whether or not the shaft door was moved during an interruption of the power supply.

* * * * *